US009500190B2

(12) United States Patent
Moreira-Espinoza

(10) Patent No.: US 9,500,190 B2
(45) Date of Patent: Nov. 22, 2016

(54) HIGH PRESSURE SOLENOID PUMP

(75) Inventor: Edison X. Moreira-Espinoza, Horseheads, NY (US)

(73) Assignee: Motor Components, LLC, Elmira Heights, NY (US)

( * ) Notice: Subject to any disclaimer, the term of this patent is extended or adjusted under 35 U.S.C. 154(b) by 901 days.

(21) Appl. No.: 13/192,824

(22) Filed: Jul. 28, 2011

(65) Prior Publication Data

US 2013/0028753 A1 Jan. 31, 2013

(51) Int. Cl.
*F04B 17/04* (2006.01)
*F04B 35/04* (2006.01)
*F04B 49/06* (2006.01)

(52) U.S. Cl.
CPC ..... *F04B 35/045* (2013.01); *F04B 17/04* (2013.01); *F04B 49/065* (2013.01); *F04B 2203/0402* (2013.01)

(58) Field of Classification Search
CPC ..... F04B 17/04; F04B 35/045; F04B 2205/05; F02M 59/466; F02M 63/0225
USPC ..... 417/44.11; 251/129.04, 129.09, 129.15; 361/156, 160
See application file for complete search history.

(56) References Cited

U.S. PATENT DOCUMENTS 4,219,863 A * 8/1980 Takeshima ..... 361/156
6,016,791 A * 1/2000 Thomas ..... F02D 41/3845 123/456
7,821,159 B2 * 10/2010 Day ..... 307/65
2006/0221534 A1 * 10/2006 Oide ..... H01H 47/325 361/160
2010/0037644 A1 * 2/2010 Ward ..... 62/291

* cited by examiner

*Primary Examiner* — Patrick Hamo
(74) *Attorney, Agent, or Firm* — Simpson & Simpson, PLLC

(57) ABSTRACT

A solenoid pump, including: an inlet port, an outlet port, and a first through-bore connecting the inlet and outlet ports; a plunger disposed within the first through-bore and including a second through-bore; a spring arranged to urge the plunger toward the outlet port; a solenoid coil disposed about a portion of the plunger and arranged to displace the plunger toward the inlet port in response to coil power applied to the solenoid coil; and a control unit for: accepting an input voltage; generating the coil power during an interval equal to a first time period; supplying the coil power to the solenoid coil; and selecting a duration of the first time period such that the duration of the first time period varies according to the input voltage.

7 Claims, 7 Drawing Sheets

| Modified Astable Circuit | | | | | | | |
|---|---|---|---|---|---|---|---|
| Vdc | Toff (ms) | Ton (ms) | Duty Cycle | Frequency (Hz) | Average Current (A) | Max Current | Average Power |
| 10.00 | 30.00 | 23.00 | 56.60 | 18.87 | 1.70 | 3.00 | 16.98 |
| 12.00 | 21.00 | 23.00 | 47.73 | 22.73 | 2.39 | 5.00 | 28.64 |
| 14.00 | 16.00 | 23.00 | 41.03 | 25.64 | 2.26 | 5.50 | 31.59 |

Fig. 5a

| Astable Circuit | | | | | | | |
|---|---|---|---|---|---|---|---|
| Vdc | Toff (ms) | Ton (ms) | Duty Cycle | Frequency (Hz) | Average Current (A) | Max Current | Average Power |
| 10.00 | 23.00 | 23.00 | 50.00 | 21.74 | 1.50 | 3.00 | 15.00 |
| 12.00 | 23.00 | 23.00 | 50.00 | 21.74 | 2.50 | 5.00 | 30.00 |
| 14.00 | 23.00 | 23.00 | 50.00 | 21.74 | 2.26 | 5.50 | 38.50 |

PRIOR ART

Fig. 5b

HIGH PRESSURE SOLENOID PUMP

FIELD OF THE INVENTION

The invention relates generally to a solenoid pump with a conical, variable rate spring to enable maximum displacement of a plunger in the pump and to increase back pressure values under which the pump can operate. The invention also generally relates to a control scheme for a solenoid pump that varies a duty cycle according an input voltage used to power the pump.

BACKGROUND OF THE INVENTION

Known solenoid pumps use linear springs to bias a plunger against displacement by a solenoid coil in a pumping cycle. When the springs are fully compressed, the springs occupy an undesirably large space since the coils for the springs stack upon each other. Known control schemes for solenoid pumps use a fixed duty cycle, typically 50, regardless of the magnitude of the input voltage to be used to energize the solenoid coils for the pumps. As a result, too little power is delivered to the coils for low values of the input voltage and the coils remain energized even after plungers for the pumps have fully displaced to fully compress the springs for the pumps. As a result, the pumps consume unnecessarily high amounts of energy and undesirable amounts of heat are generated, which degrades operation of the pumps.

Typically, back pressure is present at the outlet port of a solenoid pump and limits operation of the pump, that is, the pump can operate only up to a certain back pressure level. In general, the back pressure works against the spring used to bias the plunger. For example, when the back pressure is greater than the biasing force of the spring, the pumping cycle is terminated (the plunger cannot return to a "rest" position when the coil is de-energized). The known use of linear springs limits the back pressure under which known solenoid pumps can operate. The spring biasing force must be relatively lower to enable the initiation of the plunger displacement when the coil is energized. Since the spring is linear, only the same relatively lower biasing force is available to counteract the back pressure. Known solenoid pumps cannot operate with a backpressure over about 10 psi.

Common rail systems use a relatively low pressure pump to pump fuel from a fuel source to a high pressure pump. The high pressure pump supplies fuel from the low pressure pump to a distribution line, for example, a distribution pipe feeding fuel injectors for an engine. The high pressure pump in a common rail system can operate at pressures of over 29,000 psi. A pressure regulating valve placed between the low and high pressure pumps typically creates a back pressure on the outlet port of the low pressure pump greater than the 10 psi maximum backpressure under which known solenoid pumps can operate. Thus, known common rail systems teach the use of pumps other than solenoid pumps.

SUMMARY OF THE INVENTION

According to aspects illustrated herein, there is provided a control unit for a solenoid pump including: an inlet port, an outlet port, and a first through-bore connecting the inlet and outlet ports; a plunger disposed within the first through-bore and including a second through-bore; a spring arranged to urge the plunger toward the outlet port; a solenoid coil disposed about a portion of the plunger and arranged to displace the plunger toward the inlet port in response to coil power applied to the solenoid coil, the control unit including: an input for accepting an input voltage; and a power circuit for: generating the coil power during an interval equal to a time period; supplying the coil power to the solenoid coil; and selecting a duration of the time period such that the duration of the time period varies according to the input voltage.

According to aspects illustrated herein, there is provided a solenoid pump, including: an inlet port, an outlet port, and a first through-bore connecting the inlet and outlet ports; a plunger disposed within the first through-bore and including a second through-bore; a spring arranged to urge the plunger toward the outlet port; a solenoid coil disposed about a portion of the plunger and arranged to displace the plunger toward the inlet port in response to coil power applied to the solenoid coil; and a control unit for: accepting an input voltage; generating the coil power during an interval equal to a first time period; supplying the coil power to the solenoid coil; and selecting a duration of the first time period such that the duration of the first time period varies according to the input voltage.

According to aspects illustrated herein, there is provided a solenoid pump, including: a housing with an inlet port and an outlet port; a first through-bore connecting the inlet and outlet ports; a plunger disposed within the first through-bore and including a second through-bore; a spring arranged to urge the plunger toward the outlet port; a solenoid coil arranged to displace the plunger toward the inlet port in response to a coil power applied to the solenoid coil; and a control unit for controlling operation of the solenoid coil such that when the solenoid coil is energized by the coil power to displace the plunger and the spring is fully compressed by the plunger, coils forming the spring are aligned in a direction orthogonal to a longitudinal axis passing through the inlet and outlet ports.

According to aspects illustrated herein, there is provided a solenoid pump, including: a housing with an inlet port and an outlet port; a first through-bore connecting the inlet and outlet ports; a sleeve disposed within the first through-bore and displaceable parallel to a longitudinal axis passing through the inlet and outlet ports; a plunger disposed within the first through-bore, displaceable parallel to the longitudinal axis, and including a second through-bore; a spring arranged to urge the plunger toward the outlet port; a solenoid coil arranged to displace the plunger toward the inlet port in response to a coil power applied to the solenoid coil; and a control unit for controlling operation of the solenoid coil such that fluid is transferred from the inlet port to the outlet port through the second through bore.

According to aspects illustrated herein, there is provided a method of operating a control unit for a solenoid pump including: an inlet port, an outlet port, and a first through-bore connecting the inlet and outlet ports; a plunger disposed within the first through-bore and including a second through-bore; a spring arranged to urge the plunger toward the outlet port; a solenoid coil disposed about a portion of the plunger and arranged to displace the plunger toward the inlet port in response to coil power applied to the solenoid coil, the method including: using an input to accept an input voltage; and using a power circuit to: generate the coil power during an interval equal to a time period; supply the coil power to the solenoid coil; and select a duration of the time period such that the duration of the time period varies according to the input voltage.

According to aspects illustrated herein, there is provided a method of pumping fluid using a solenoid pump including: an inlet port, an outlet port, and a first through-bore connecting the inlet and outlet ports; a plunger disposed within the first through-bore and including a second through-bore; a spring; a solenoid coil disposed about a portion of the valve assembly; and a control unit. The method includes: urging, using the spring, the plunger toward the outlet port; and using the control unit to: accept an input voltage; determine a magnitude of the input voltage; select a duration of a first time period such that the duration of the first time period varies according to the input voltage; generating, using the input voltage, a coil power during an interval equal to the first time period; supplying the coil power to the solenoid coil such that the plunger displaces toward the inlet port; remove the coil power such that the spring displaces the plunger toward the outlet port.

According to aspects illustrated herein, there is provided a method of pumping fluid using a solenoid pump including: a housing with an inlet port and an outlet port; a first through-bore connecting the inlet and outlet ports; a plunger disposed within the first through-bore and including a second through-bore; a spring; a solenoid coil; and a control unit. The method including: urging the plunger toward the outlet port with the spring; and using the control unit to apply a coil power to the solenoid coil to displace the plunger toward the inlet port such that the spring is fully compressed by the plunger, and coils forming the spring are aligned in a direction orthogonal to a longitudinal axis passing through the inlet and outlet ports.

BRIEF DESCRIPTION OF THE DRAWINGS

The nature and mode of operation of the present invention will now be more fully described in the following detailed description of the invention taken with the accompanying drawing figures, in which:

FIG. 5A is a table showing duty cycle data for a solenoid pump using a control scheme varying a time for generating coil power;

FIG. 5B is a table for a prior art control scheme with a fixed duty cycle;

DETAILED DESCRIPTION OF THE INVENTION

At the outset, it should be appreciated that like drawing numbers on different drawing views identify identical, or functionally similar, structural elements of the invention. It is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, exemplary methods, devices, and materials are now described.

Figure 1:
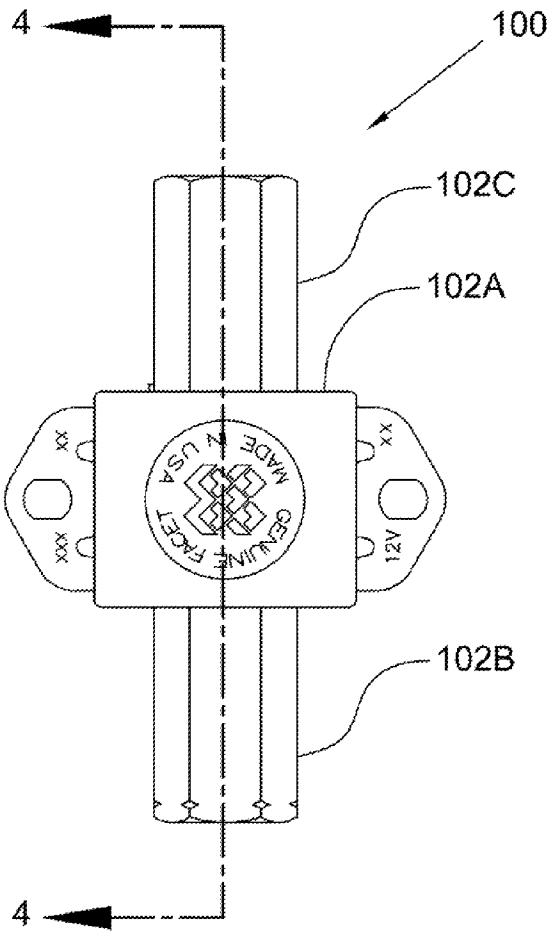
FIG. 1 is a plan view of a high pressure solenoid pump.

FIG. 1 is a plan view of high pressure solenoid pump 100.

Figure 2:
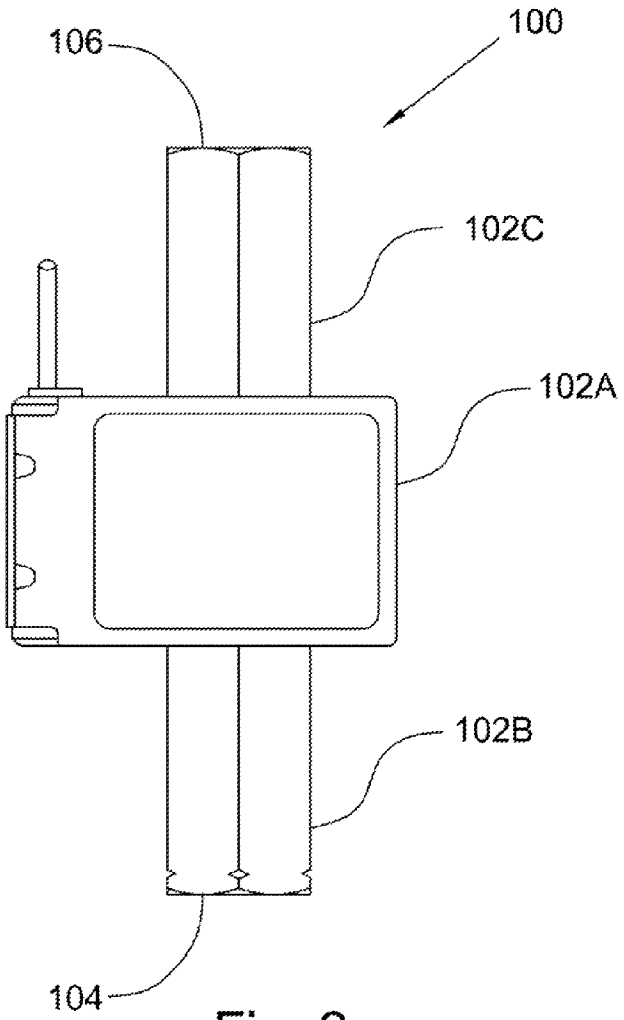
FIG. 2 is a side view of the pump shown in FIG. 1.

FIG. 2 is a side view of pump 100 shown in FIG. 1.

Figure 3:
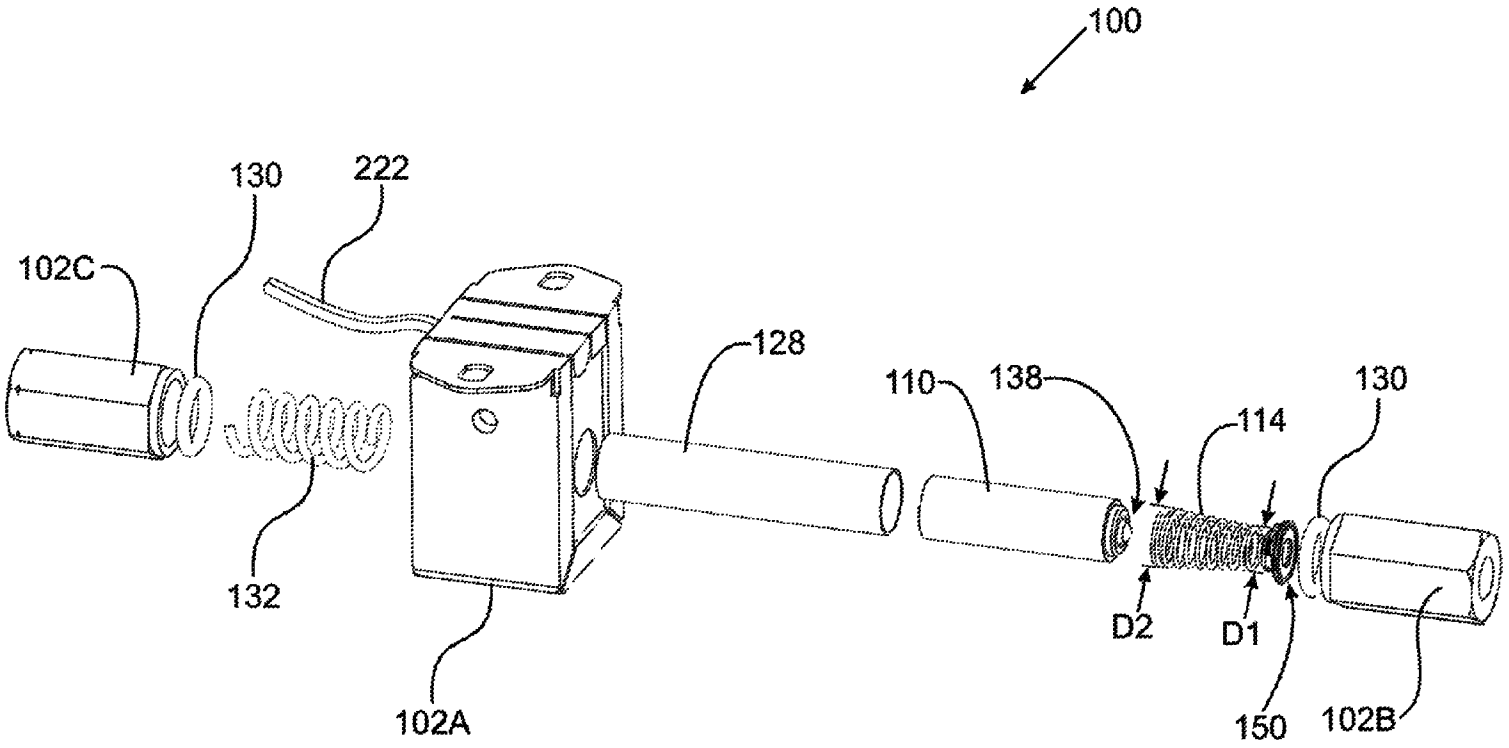
FIG. 3 is an exploded view of the high pressure solenoid pump shown in FIG. 1.

FIG. 3 is an exploded view of high pressure solenoid pump 100 shown in FIG. 1.

Figure 4A:
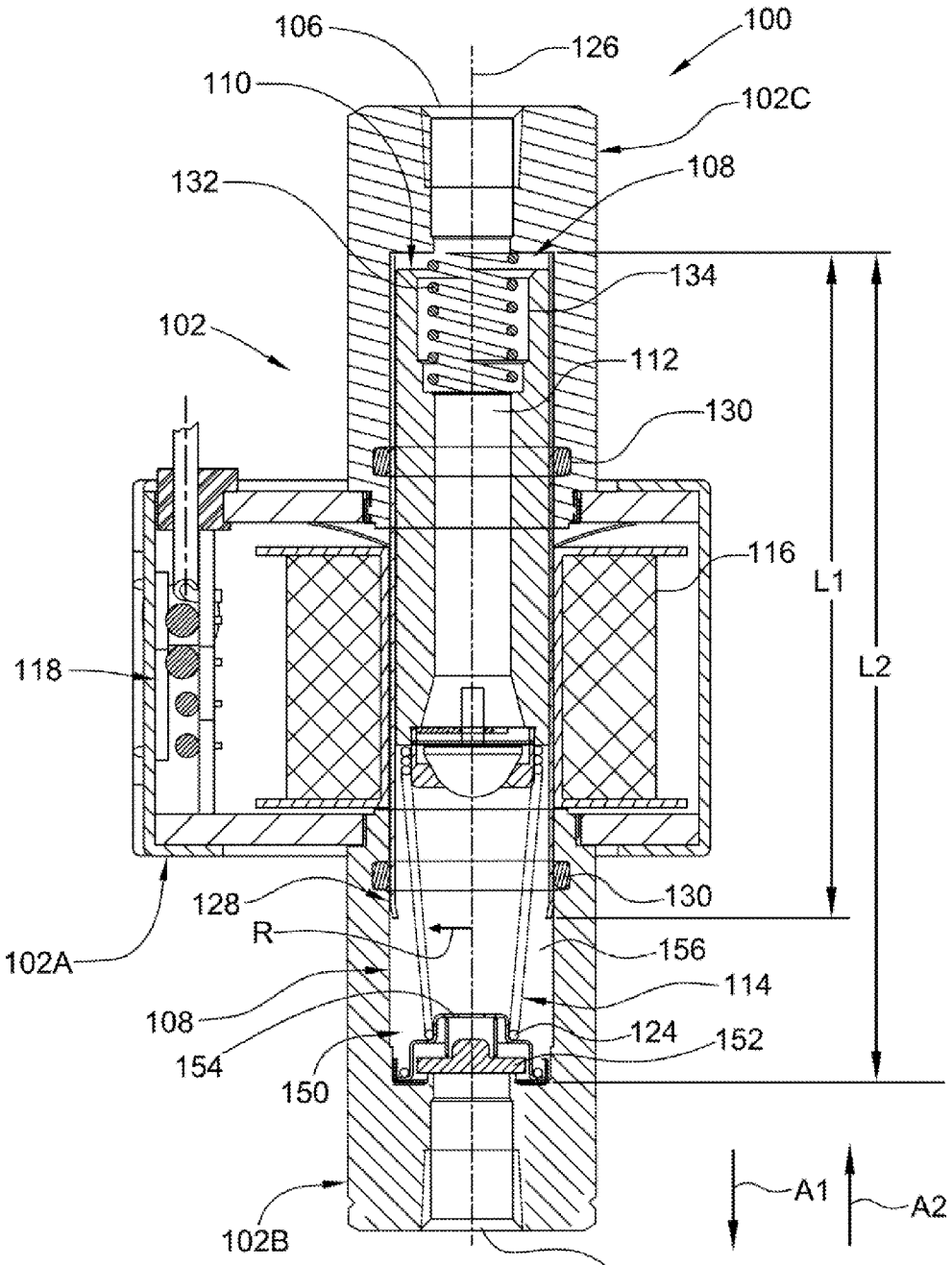
FIGS. 4A-4C are respective cross-sectional views of the high pressure solenoid pump shown in FIG. 1 generally along line 4-4 in FIG. 1, depicting various stages of a pumping cycle.
Figure 4B:
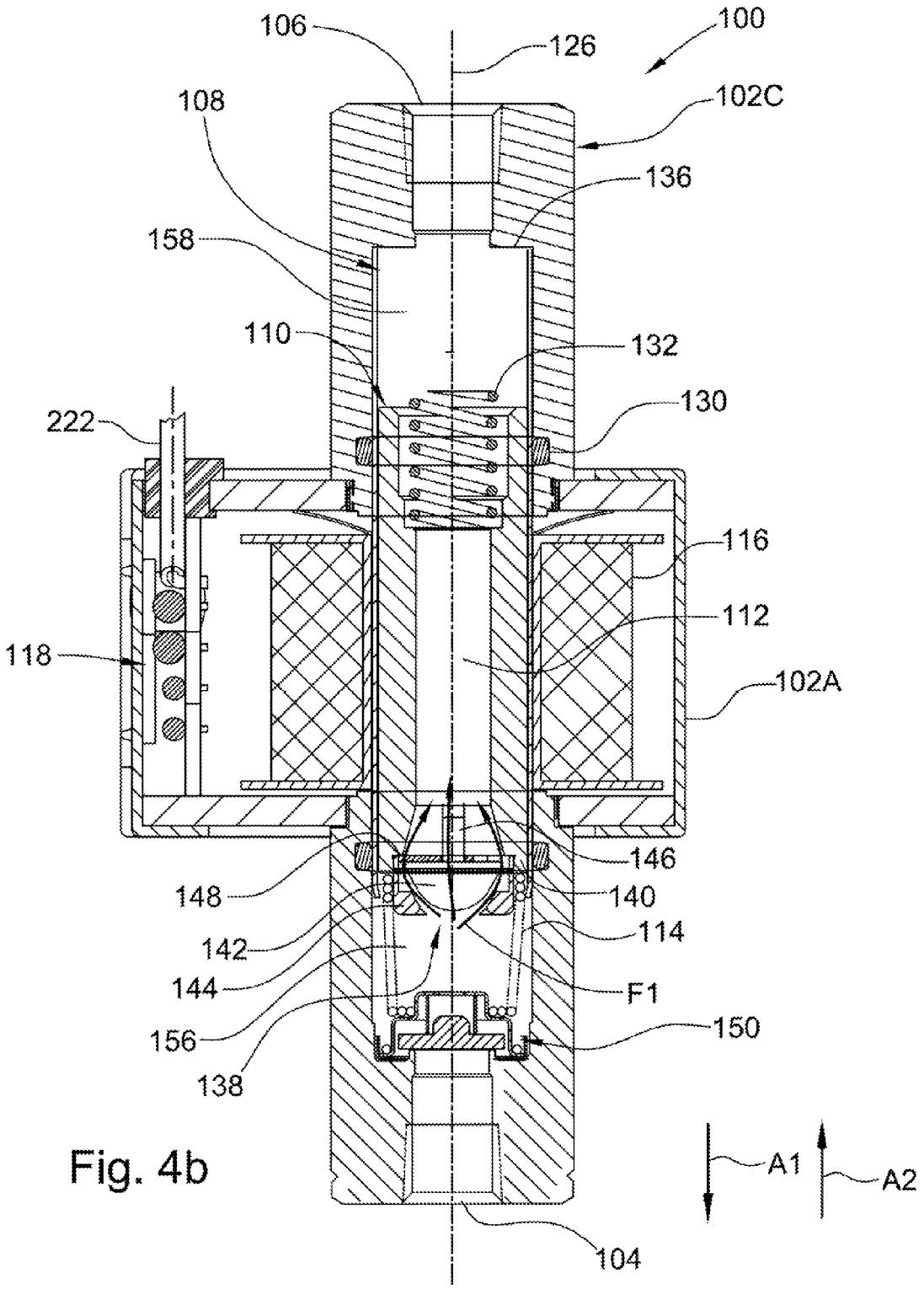
Figure 4C:
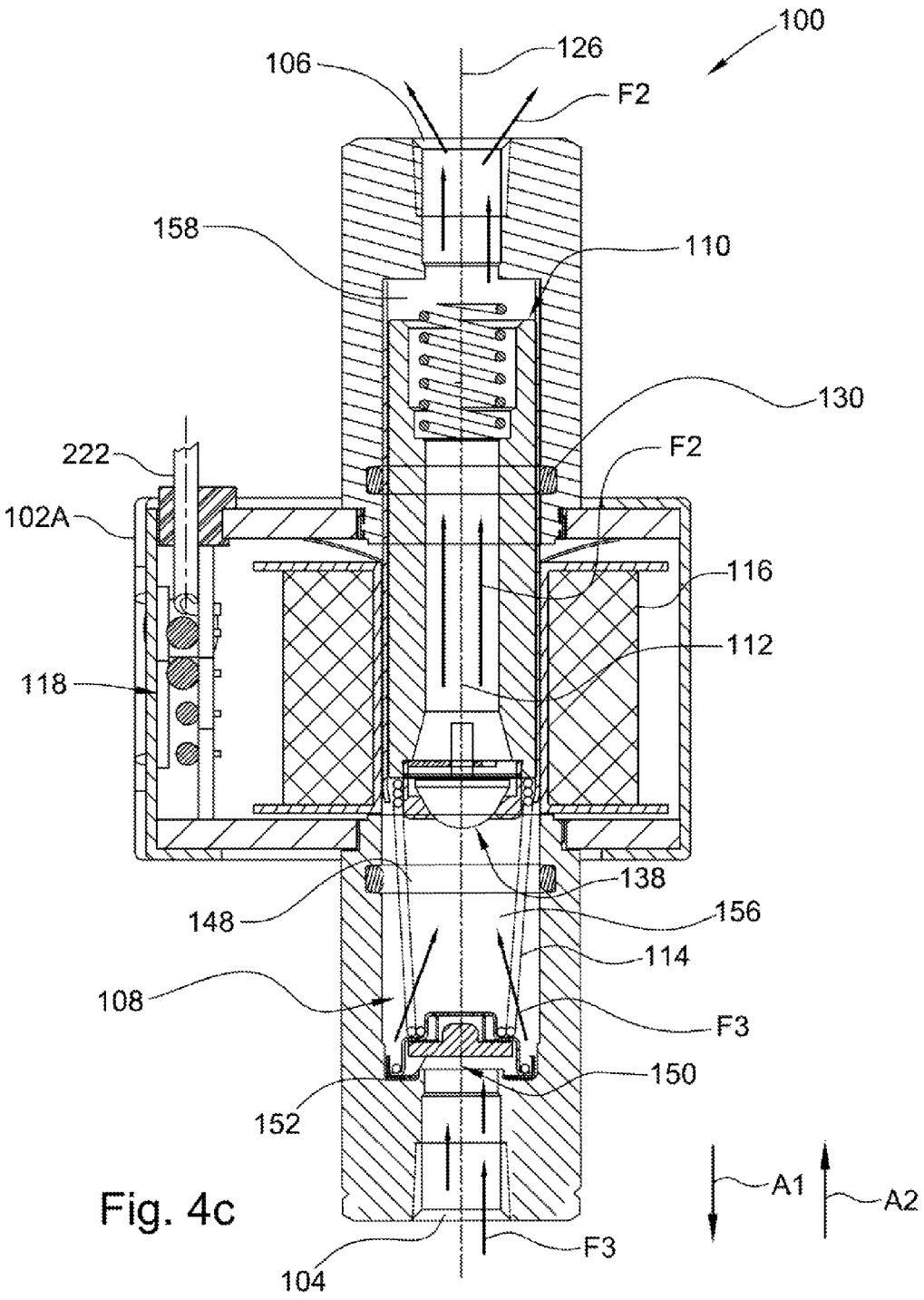

FIGS. 4A-4C are respective cross-sectional views of high pressure solenoid pump 100 shown in FIG. 1 generally along line 4-4 in FIG. 1, depicting various stages of a pumping cycle. The following should be viewed in light of FIGS. 1 through 4C. Pump 100 includes housing 102 with inlet port 104 and outlet port 106. In an example embodiment, housing 102 is formed by main housing 102A, inlet housing 102B, and outlet housing 102C. Housings 102B and 102C are connected to the main housing by any means known in the art, for example, threads. Pump 100 includes through-bore 108 connecting the inlet and outlet ports, and plunger 110 disposed within through-bore 108 and including through-bore 112. Pump 100 includes spring 114 arranged to urge the plunger toward the outlet port, solenoid coil 116 arranged to displace the plunger toward the inlet port in response to a coil power applied to the solenoid coil, and control unit 118 for controlling operation of the solenoid coil.

Spring 114 is a variable rate spring. By "variable rate spring" we mean that resistance of the spring to compression of the spring in direction A1 toward the inlet port increases as the spring is compressed in direction A1, for example, by the plunger. Stated otherwise, referring to Hooke's Law: $F=-kx$, the constant k for the spring increases as the spring is compressed. Thus, the further the spring is compressed, the more force is needed to continuing compressing the spring. For example, when the plunger begins displacing in direction A1 from the position shown in FIG. 4A, a certain amount of force is required to compress the spring. As the plunger continues to displace to the position shown in FIG. 4B, an increasingly greater amount of force is required to continue compressing the spring. The rate for spring 114 may vary according to pump type and the pressure output of the pump, for example, k for the spring can be varied.

Spring 114 has a conical shape, for example, diameter D1 at end 120 of the spring closest to the inlet port in FIG. 4A is less than diameter D2 at end 122 of the spring, opposite end 120. Thus, when the spring is compressed as shown in FIG. 4B, compressed coils 124 forming the spring are aligned in direction R orthogonal to longitudinal axis 126 passing through the inlet and outlet ports.

In an example embodiment, the pump includes sleeve 128 disposed within through-bore 108 and displaceable parallel to axis 126. The plunger is disposed within the sleeve and in an example embodiment is displaceable within the sleeve parallel to the longitudinal axis. Seals 130, for example, O-rings, provide a seal between housing 102 and the sleeve, while enabling movement of the sleeve within bore 108. Length L1 of the sleeve is less than length L2 of through bore 108, thus, the sleeve "floats" within bore 108. Advantageously, having sleeve 128 "float" within bore 108 increases the ease of fabrication of pump 100, since fabrication steps that would be needed to fix the sleeve within the pump are eliminated. Further, having the sleeve float enables greater flexibility since sleeves with different lengths L1 can be easily installed. Also, since L1 is less than L2, tolerances for L1 can be relaxed, reducing manufacturing cost and complexity. In an example embodiment, sleeve 128 is made from a non-magnetic material.

The following provides further example detail regarding pump 100 and an example operation of pump 100. The plunger is arranged to pass fluid through through-bore 112 and longitudinally traverses the pump between the inlet and outlet ports. In an example embodiment, bumper spring 132 is disposed in end 134 of the plunger. The bumper spring contacts shoulder 136 in the housing to cushion the impact of the plunger as the plunger moves from the position of FIG. 4B to the fully retracted position of FIG. 4A. Sleeve 128 serves as the primary location wherein mechanical pumping operations are performed. Suction valve assembly 138 is disposed at end 140 of the plunger. In an example embodiment, the suction valve assembly includes cap 142, seat 144, and stem 146 passing through retainer element 148. The operation of the suction valve assembly is further described below.

Pump 100 includes one-way check valve 150. The check valve enables fluid flow through the inlet port toward the outlet port in direction A2 and blocks fluid flow in the opposite direction, A1. In an example embodiment, the check valve includes sealing element 152 within valve housing 154. The sealing element seals against the housing, for example, inlet housing 102B to block flow out of the pump through the inlet port. For example, the one-way check valve is used as part of drawing fuel from a fuel source such as a fuel tank.

FIG. 4A shows plunger 110, the suction valve assembly, the check valve, and spring 114 in respective rest positions. While coil 116 is not energized, spring 114 biases, or urges, plunger 110 in direction A2 such that the bumper spring is in contact with shoulder 136. If backpressure exists, i.e., pressure caused by fluid entering from outlet port 106, cap 142 forms a seal with seat 144 to prevent fluid from flowing from bore 112 past the suction valve assembly in direction A1. The seal in the check valve prevents fluid flowing from flowing past the check valve and out through the inlet port.

FIG. 4B illustrates coil 116 as being energized, which forms a magnetic field. The magnetic field created by the energized coil imparts a directional force upon plunger 110 in direction A1 toward inlet port 104, causing the plunger to displace in direction A1 and spring 114 to compress. As a result of the movement in direction A1 and the configuration of the suction valve assembly, a negative pressure, or suction, is formed in chamber 158 of through-bore 108 and through-bore 112, displacing cap 142 from seat 144. Fluid present in chamber 156 in through-bore 108 just prior to energizing coil 116 is sucked around the suction valve assembly, as shown by flow lines F1, and into chamber 158 in through-bore 112. During this stage, fluid is prevented from moving between chamber 156 and inlet port 102 by the check valve.

Referring now to FIG. 4C, as coil 116 is de-energized, the magnetic field collapses. As a result, plunger 110 is no longer acted upon by a magnetic force and is urged in direction A2 toward to the rest location of FIG. 4A by the bias of spring 114. Two simultaneous events occur during the movement of plunger 110 in direction A2. First, fluid contained in bore 112 and chamber 158 is forced out of outlet port 104, as shown by fluid flow lines F2. The fluid in bore 112 and chamber 158 is prevented from entering chamber 156 by the seal created between cap 142 and seat 144. Simultaneously, fluid is replenished in chamber 156 as follows. As plunger 110 moves in direction A2, a negative pressure, or suction, is created in chamber 156. The negative pressure causes the check valve to open, allowing fluid to be drawn from inlet port 102 into chamber 156, as shown by fluid flow lines F3.

The operation described above regarding FIGS. 4A through 4C is cyclically repeated during the use of the pump. As described below, the control unit energizes the solenoid coil for a particular time period $T_{off}$, and de-energizes the solenoid coil for a particular time period $T_{on}$ for example, while generating the power to operate the solenoid coil. This means that during each cycle of operation, the plunger is biased in direction A1 by electromagnetic force for $T_{off}$, and then biased in direction A2 by spring 114 for $T_{on}$. The reciprocal motion causes fluid to flow through inlet port 102 and the check valve into chamber 156, through the suction valve assembly into chamber 158, and through outlet port 106, thereby creating a continuous flow of fluid.

As noted above, some amount of back pressure, that is, pressure exerted through the outlet port into through-bore 108 in direction A1, is typically present during operation of pump 100. The back pressure biases the plunger in direction A1, against the biasing of spring 114. When the force of the back pressure is greater than the force exerted by spring 114, for example, spring 114 no longer can urge the plunger in direction A2 from the position in FIG. 4B, the reciprocating action of the plunger is terminated and fluid no longer can be transferred as described above. Known solenoid pumps using nominal 12 VDC input power cannot operate (pump fluid) above about 10 psi of back pressure.

Advantageously, pump 100 is able to operate (pump fluid) up to about 15 psi of back pressure. The ability of pump 100 to operate at greater back pressures is at least partly due to the variable rate of spring 114. Due to the characteristics associated with operation of the solenoid coil, it is desirable to minimize the amount of resistance the plunger must overcome at the onset of a cycle. As noted above, the variable rate results in spring 114 advantageously generating relatively less biasing force resisting movement of the plunger in direction A1 at the onset of a pump cycle, for example, starting in the position of FIG. 4A. Also as noted above, the biasing force of spring 114 increases as the spring is compressed, such that in the position shown in FIG. 4B, the biasing force is maximized. This maximized force initiates the movement of the plunger in direction A2 after the coil is de-energized. Advantageously, the biasing force generated by spring 114 when the coil is de-energized determines the amount of back pressure under which pump 100 can operate. That is, the greatest amount of biasing force from spring 114 is needed to initiate displacement of the plunger against the back pressure when the solenoid coil is de-energized. Thus, spring 114 provides the least resistance when less resistance is advantageous, that is, when the solenoid coil is first energized and the displacement of the plunger in direction A1 begins; and provides the most resistance when more resistance is advantageous, that is, when the solenoid coil is de-energized and spring 114 must operate against the back pressure.

Pump 100 can be used in common rail systems. As noted above, in a common rail system a relatively low pressure pump is used to pump fuel from a fuel source to a high pressure pump. For a common rail system, the back pressure on the outlet port of the low pressure pump is greater than the 10 psi maximum backpressure under which known solenoid pumps can operate. Advantageously, the approximately 15 psi maximum backpressure under which pump 100 can operate is sufficient to enable operation of pump 100 in a common rail system.

FIG. 5A is a table showing duty cycle data for a solenoid pump using a control scheme varying a time for generating coil power CP.

FIG. 5B is a table for a prior art control scheme with a fixed duty cycle. By duty cycle for a pump, we mean the percentage of the cycle during which the coil power is generated using the input voltage. Pump 100 is referenced in the discussion that follows; however, it should be understood that the control scheme described below is applicable to any solenoid pump using a solenoid coil to displace an element to transfer fluid from an inlet port for the pump to an outlet port for the pump. Control unit 118 is for controlling operation of the solenoid coil. The control unit is for accepting input voltage IV, for example, from an outside source, such as a battery of a vehicle in which the pump is installed. It should be understood that any source of voltage known in the art can be used to provide IV.

The control unit makes a determination regarding a magnitude of IV and generates CP during an interval equal to a time period $T_{off}$. That is, the interval is the time period used by the control unit to generate CP. The control unit supplies the coil power to the solenoid coil. The control unit selects a duration of $T_{off}$ such that the duration of $T_{off}$ varies according to the determination of the magnitude of the input voltage. That is, the duration of $T_{off}$ is proportional to the magnitude of IV. The combination of the magnitude of IV and the duration of $T_{off}$ determine the magnitude of CP as further described infra.

The following should be viewed in light of FIGS. 4A through 5B. A cycle for pump 100 is defined as the time required for the pump to operate such that the plunger begins at the position shown in FIG. 4A and returns to the position shown in FIG. 4C. That is, a cycle is a cycle of operation for the plunger, spring 114, and the pump to transfer a fluid from the inlet port to the outlet port. At the start of the cycle, the solenoid coil is de-energized by the control unit such that the plunger is in the position, within through-bore 108 and proximate the outlet port, shown in FIG. 4A. To complete the cycle: the control unit energizes the solenoid coil by applying the coil power for time period $T_{off}$ such that the plunger is displaced to the position, within sleeve 128 and proximate the inlet port, shown in FIG. 4B; and the control unit de-energizes the solenoid coil by removing the coil power such that the plunger moves to the position in FIG. 4C and then to the position shown in FIG. 4A.

Advantageously, the control unit is for decreasing the duration of $T_{off}$ as the magnitude of the input voltage increases; and increasing the duration of $T_{off}$ as the magnitude of the input voltage decreases. In an example embodiment, the control unit compares IV to a pre-determined value. If IV is greater than the value, the control unit decreases $T_{off}$ in proportion to the difference between IV and the value, with $T_{off}$ decreasing as the difference increases. If IV is less than the value, the control unit increases $T_{off}$ in proportion to the difference between IV and the value, with $T_{off}$ increasing as the difference increases. FIG. 5A shows an exemplary variation of $T_{off}$ with respect the variation of IV. In an example embodiment, a minimum time period is necessary for the plunger to fully displace from the position shown in FIG. 4A to the position shown in FIG. 4B, and the control unit ensures that $T_{off}$ is greater than the minimum time period.

As noted above, the control unit is for supplying the coil power to the solenoid coil during time period $T_{off}$. For an input voltage greater than a pre-determined value, the control unit is for selecting the duration of $T_{off}$ to be less than the duration of T. For an input voltage less than the pre-determined value, the control unit is for selecting the duration of $T_{off}$ to be greater than the duration of $T_{on}$. In an example embodiment, $T_{on}$ is constant regardless of $T_{off}$.

As noted above, a duty cycle for a pump is defined as the percentage of the cycle during which the coil power is generated using the input voltage. For example, for a control scheme charging a capacitor with the input voltage to generate the coil power, the duty cycle is the percentage of the cycle during which the capacitor is charged. For the control scheme depicted in FIG. 5A and described above, the duty cycle advantageously varies according to the magnitude of the input voltage. For example, in FIG. 5A, the duty cycle decreases with increasing IV. In contrast, as shown in FIG. 5B, the duty cycle is constant regardless of the value of IV, with attendant disadvantages and problems as described below.

In an example embodiment, IV is a direct current voltage and CP is an alternating current voltage. The control unit is for: supplying the coil power at a specific frequency; and selecting a magnitude of the frequency such that the magnitude of the frequency varies according to the magnitude of the input voltage. Thus, the control unit decreases the magnitude of the frequency as the magnitude of the input voltage decreases, and increases the magnitude of the frequency as the magnitude of the input voltage increases as shown in FIG. 4A.

As shown in FIG. 5B, and noted supra, known control schemes do not vary $T_{off}$ or CP to account for changes in IV, that is, the duty cycle is constant. For example, in FIG. 5B, $T_{off}$ is 23 milliseconds (ms) regardless of the value for IV. As a result, a less than desirable amount of power is delivered to the solenoid coil for lower values of IV, for example, 10V in FIG. 5B, resulting in incomplete displacement of the plunger by the solenoid and an undesirable decrease in pumping capacity for the pump. As the value of IV increases with the known control schemes, a different problem arises. At higher values of IV, for example, 14V in FIG. 5B, the plunger is fully extended for a relatively long period before the expiration of $T_{off}$. As a result, the solenoid coil continues to be energized even though the plunger is fully extended, which leads to undesirable overheating of components in the pump, such as control circuitry. For example, electronic components in the circuitry, such as transistors, can overheat due to the preceding conditions. Further, the power efficiency of the pump is decreased since excessive amounts of power are consumed by components in the pump, such as the control circuitry, without producing any additional useful work.

Figure 6:
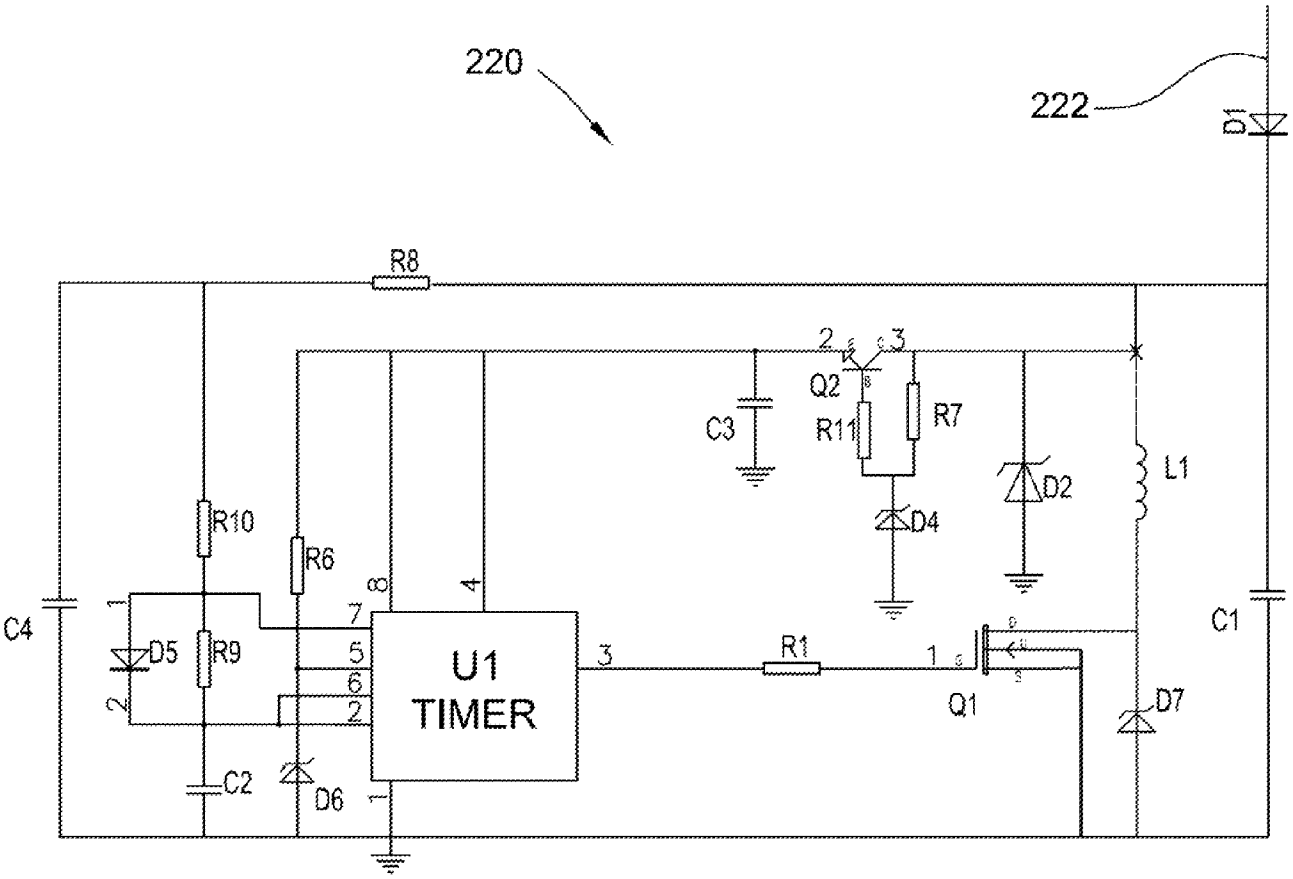
FIG. 6 depicts an exemplary power circuit for a control scheme varying a time for generating coil power according to input voltage.

FIG. 6 depicts exemplary power circuit 220 for a control scheme varying a time for generating coil power according to input voltage. The following should be viewed in light of FIGS. 4A through 6. Pump 100 is used as an example in the discussion that follows. However, it should be understood that the control scheme described below is applicable to any pump using a solenoid coil to displace an element to transfer fluid from an inlet port for the pump to an outlet port for the pump and is not limited to pump 100. In an example embodiment, control unit 118 includes circuit 220 shown in FIG. 6. Although circuit 220 is described with respect to control unit 118, it should be understood that circuit 220 is applicable to any pump using a solenoid coil to displace an element to transfer fluid from an inlet port for the pump to an outlet port for the pump and is not limited to control unit 118.

In an example embodiment, control unit 118 includes power input line 222, power circuit 220 includes voltage storage element C2, and the control unit is for charging the voltage storage element with the input voltage to generate the coil power during the interval noted above for $T_{off}$, and discharging the voltage storage element to supply the coil power to the solenoid coil. In an example embodiment, element C2 is a capacitor.

In an example embodiment, circuit 220 includes transistor Q1, for example, a metal oxide semiconductor field effect transistor (MOSFET), and timer Ul. Timer Ul can be any timer known in the art, for example, a 555 timer. In an example embodiment, pin 5 on the timer is clamped to establish a predetermined value against which the input voltage is compared. Pin 5 is the control voltage for a comparator circuit in the timer. In an example embodiment, a Zener diode, for example, diode D6 is used to clamp pin 5. To produce the values shown in FIG. 5A, the voltage is clamped at 5.1V; however, it should be understood that other clamping voltage values are possible. The timer turns Q1 off during $T_{on}$ such that the coil is de-energized and C2 is charged. The timer turns Q1 on during $T_{off}$ such that C2 is discharged and the coil is energized.

The control scheme described above, for example, selecting the duration of $T_{off}$ according to a magnitude of IV, has at least the following advantages. In many applications, the magnitude of IV varies according to operating conditions affecting the source of IV. For example, when the pump is used in a vehicular application and a battery for a vehicle is used to supply IV, the magnitude of IV may be relatively lower due to the age or condition of the battery, cold weather impacting the battery, or a start-up condition for the vehicle. As a result, the magnitude of IV may be undesirably low at the onset of operation of the pump and may increase as the vehicle continues to operate, for example, as the battery warms up or is charged.

Thus, during typical operation, it is expected that IV will vary, for example, as shown in FIGS. 5A and 5B. As noted supra, known control schemes do not vary the duty cycle to account for such variations of IV. Thus, undesirably low power is delivered to the solenoid for lower input voltage values, resulting in a loss of pumping performance, and excessive power is delivered to the solenoid for larger input voltage values, resulting in overheating of components in the pump and excessive power consumption by the pump.

Advantageously, the control scheme described supra for FIGS. 5A and 6 matches generation of CP to actual IV conditions, for example, controlling a duty cycle according to actual IV conditions. As a result, CP is increased at lower levels for IV to ensure optimal pumping rates, and CP is reduced at higher levels to avoid overheating components and to increase energy efficiency.

Thus, it is seen that the objects of the invention are efficiently obtained, although changes and modifications to the invention should be readily apparent to those having ordinary skill in the art, without departing from the spirit or scope of the invention as claimed. Although the invention is described by reference to a specific preferred embodiment, it is clear that variations can be made without departing from the scope or spirit of the invention as claimed.

What is claimed is:

1. A solenoid pump, comprising:

an inlet port, an outlet port, and a first through-bore connecting the inlet and outlet ports;

a plunger disposed within the first through-bore and including a second through-bore;

a spring arranged to urge the plunger toward the outlet port;

a solenoid coil disposed about a portion of the plunger and arranged to displace the plunger toward the inlet port in response to direct current coil power applied to the solenoid coil; and, a control unit including:

an input for accepting a direct current input voltage; and, a power circuit for:

receiving the direct current input voltage;

generating the direct current coil power during an interval equal to a first time period;

supplying the direct current coil power to the solenoid coil; and, selecting a duration of the first time period such that the duration of the first time period varies according to the direct current input voltage, wherein the control unit is for:

comparing the direct current input voltage to a pre-determined value; and, selecting the duration of the first time period according to a difference between the direct current input voltage and the pre-determined value.

2. The solenoid pump of claim 1, wherein the control unit is for:

decreasing the duration of the first time period as a magnitude of the direct current input voltage increases; and, increasing the duration of the first time period as the magnitude of the direct current input voltage decreases.

3. The solenoid pump of claim wherein:

the control unit includes a voltage storage element; and, the control unit is for:

charging the voltage storage element with the direct current input voltage to generate the direct current coil power during the interval; and, discharging the voltage storage element to supply the direct current coil power to the solenoid coil.

4. The solenoid pump of claim 1, wherein the control unit is for:

supplying the direct current coil power at a frequency; and, selecting a magnitude of the frequency such that the magnitude of the frequency varies according to the magnitude of the direct current input voltage.

5. The solenoid pump of claim 1, wherein the control unit is for:

decreasing the magnitude of the frequency as the magnitude of the direct current input voltage decreases; and, increasing the magnitude of the frequency as the magnitude of the direct current input voltage increases.

6. The solenoid pump of claim 1, wherein:

the power circuit includes a timer; and, the control unit is for using the timer to set the pre-determined value.

7. A solenoid pump, comprising:

an inlet port, an outlet port, and a first through-bore connecting the inlet and outlet ports;

a plunger disposed within the first through-bore and including a second through-bore;

a spring arranged to urge the plunger toward the outlet port;

a solenoid coil disposed about a portion of the plunger and arranged to displace the plunger toward the inlet port in response to direct current coil power applied to the solenoid coil; and, a control unit including:

an input for accepting a direct current input voltage;

a power circuit:

for:

receiving the direct current input voltage;

generating direct current coil power during an interval equal to a first time period; and, supplying the direct current coil power to the solenoid coil; and, including a timer configured to select a duration of the first time period such that the duration of the first time period varies according to the direct current input voltage.

* * * * *